US006953036B2

(12) United States Patent
Ishii

(10) Patent No.: US 6,953,036 B2
(45) Date of Patent: Oct. 11, 2005

(54) TILE CUTTER

(75) Inventor: Akinori Ishii, Miki (JP)

(73) Assignee: Ishii Chokokogu Mfg. Co., Ltd., Hyogo (JP)

( * ) Notice: Subject to any disclaimer, the term of this patent is extended or adjusted under 35 U.S.C. 154(b) by 0 days.

(21) Appl. No.: 10/786,751

(22) Filed: Feb. 25, 2004

(65) Prior Publication Data

US 2005/0016518 A1 Jan. 27, 2005

(30) Foreign Application Priority Data

Jul. 25, 2003 (JP) ..... 2003-279856

(51) Int. Cl.[7] ..... B28D 1/32

(52) U.S. Cl. ..... 125/23.02; 125/23.01; 225/96.5

(58) Field of Search ..... 125/13.01, 13.03, 125/23.01, 23.02; 225/96.5, 96, 94; 83/886, 879

(56) References Cited

U.S. PATENT DOCUMENTS 4,922,886 A * 5/1990 Hepworth ..... 125/23.01
5,303,690 A * 4/1994 Ishii ..... 125/23.02
6,047,871 A * 4/2000 Chen ..... 225/96.5

FOREIGN PATENT DOCUMENTS

EP 1 361 032 A1 * 4/2003 ..... B28D/1/22
JP 10-193336 * 7/1998 ..... B28D/1/24

* cited by examiner

*Primary Examiner*—Dung Van Nguyen
(74) *Attorney, Agent, or Firm*—Koda & Androlia

(57) ABSTRACT

A tile cutter including a base stand, a protruding rib disposed on the base stand, bridge-like guide rails installed above the protruding rib, an operating lever sliding on the guide rails while being guided by the guide rails, and a rotary blade and a pressing member installed on the base portion of the operating lever, wherein the pressing member is comprised of a pair of pressing plates with a hollow space in between, the pressing plates are connected to each other by a C-shaped connecting element, the pressing member is supported on the base portion of the operating lever near a blade supporting shaft for the rotary blade so that the pressing member is free to swing upward and downward, and part of the base portion of the operating lever and the rotary blade enter the hollow space when the pressing member takes a hanging attitude.

2 Claims, 3 Drawing Sheets

TILE CUTTER

BACKGROUND OF THE INVENTION

1. Field of the Invention

The present invention relates to a tile cutter for cutting ceramic tiles that are to be applied to walls, floors, etc. as construction materials.

2. Prior Art

In one of known tile cutters, a rectilinear protruding rib is disposed on its base stand, guide rails are installed in a bridge-like configuration above the protruding rib, an operating lever is provided on the guide rails so as to move on the guide rails, and a rotary blade and a pressing member are provided at the base portion of this operating lever in front and back positional relationship. This structure is proposed by the inventor of the present application as a tile cutter for cutting tiles to specific dimensions, and it is disclosed in Japanese Utility Model Registration No. 2502324.

In order to cut tiles using this tile cutter, a tile that is to be cut is first placed on the base stand so that a intended cutting line of the tile is aligned with the protruding rib, then the operating lever is maneuvered so that the rotary blade rotates while being pressed against the tile surface, thus forming a cut. The pressing member is next pressed against the tile surface after the rotary blade has been raised and separated from the tile, so that the pressing member (pressing plates) presses the tile, splitting it along the cut made by the rotary blade.

In the above tile cutter, the rotary blade that forms a cut in the tile by being rotationally moved while being pressed against the tile surface is supported on the lower end of the base portion of the operating lever, and the pressing member that splits the tile at the cut by being pressed against the tile is positioned to the back of the rotary blade and supported on the base portion of the operating lever so that the pressing plate is free to swing upward and downward.

In actual tile cutting work, the operator manually pivots the pressing member upward prior to cutting, so that the pressing member is set to be raised and not to be an obstacle in the next step. In the next step, the rotary blade is moved while being pressed against the tile surface so that a cut is formed in the tile. When the cut has been formed, the operator manually lowers the pressing member from the raised position, and positions the pressing member against the end portions of the tile. Then, the operator pivots down the operating lever to press the tile with the pressing member. As a result, the tile is split along the cut.

In the above operation, the handling of the pressing member requires manual raising and manual lowering of the pressing member by the operator. Furthermore, the rotary blade and pressing member that are supported on the base portion of the operating lever are separated from each other in front and back positional relationship. In view of this structure, after the cut is made in the tile surface by the rotary blade, the operating lever as a whole must be moved and positioned on the guide rails in a fine adjustment fashion in order to cause the pressing member manually to be lowered by the operator to come into contact with specified positions on the end portions of the tile. Thus, the structure unfavorably affects the working characteristics and efficiency.

SUMMARY OF THE INVENTION

Accordingly, it is an object of the present invention to provide an easy-to-use tile cutter.

It is another object of the present invention to provide a tile cutter in which a series of operations from the formation of a cut in the tile surface by a rotary blade following the placement of the tile in a fixed position on a base stand to the pressing and splitting of the tile by the pressing plates are efficiently and reliably performed merely by operating the operating lever.

The above object is accomplished by a unique structure of the present invention for a tile cutter that includes:

a base stand, a protruding rib disposed on the base stand, guide rails installed in a bridge-like configuration above the protruding rib, an operating lever which is provided on the guide rails so as to be movable thereon while being guided by the guide rails, and a rotary blade and a pressing member installed on a base portion of the operating lever, the rotary blade forming a cut in the surface of a tile that is placed on the base stand, and the pressing member for pressing the tile surface on both (right and left) sides of the cut so as to press and split the tile; and in the present invention:

the pressing member is comprised of a pair of pressing plates with a hollow space in between so that the pressing plates are separated horizontally to the left and right, the pressing plates are respectively provided with supporting portions that are formed on facing ends of the pressing plates, the supporting portions are connected to each other by a C-shaped connecting element, the pressing member is supported on the base portion of the operating lever in the vicinity of a blade supporting shaft of the rotary blade so that the pressing member is free to swing up and down, and the base portion of the operating lever and the rotary blade can enter the interior of the hollow space when the pressing member takes a hanging attitude.

In the above structure of the tile cutter of the present invention, a tile that is to be cut is placed on the base stand with the intended cutting line of the tile aligned with the protruding rib, and an operator operates (moves) the operating lever so that the rotary blade at the base portion of the operating lever is moved from one edge to the other of the tile while being pressed against the surface of the tile, and thus a cut is formed in the surface of the tile. During this operation, the pressing member having the pressing plates is pulled along over the surface of the tile. Then, when the operating lever is pivoted upward (by the operator) at the point in time at which the formation of the cut in the surface of the tile has been completed (at the other edge), the pressing plates are pulled above the surface of the tile; as a result, the pressing member takes a hanging attitude, and the base portion of the operating lever and the rotary blade enters the hollow space of the pressing member. Accordingly, when the operating lever is pivoted down, the undersurfaces of the pressing plates of the pressing member are pressed against the surface of the tile, and the tile is thus pressed and split along the cut.

As seen from the above, in the tile cutter of the present invention, the series of operations from the formation of a cut in the surface of the tile to the splitting of the tile are efficiently and reliably accomplished by merely operating the operating lever after the tile is placed on the base stand.

Furthermore, in the above structure, the pressing member supporting shaft that supports the pressing member on the base portion of the operating lever is preferably set above and slightly behind the blade-supporting shaft that supports the rotary blade. With this arrangement, the operator stops the movement of the rotary blade at the same time that the cut is made in the tile when the rotary blade is moved while being pressed against the surface of the tile is completed, and then the operator raises the operating lever by pivoting it upward in this position so that the pressing plates of the pressing member are pulled upward and separated from the tile surface and take a hanging attitude. With this operation, since the position where the undersurfaces of the pressing plates are pressed against the tile surface in the next step that pivots down the operating lever is appropriately set, reliable pressing and splitting of a tile with good operating characteristics is realized.

Furthermore, immediately prior to the pressing and splitting of the tile that has a cut, the rotary blade that has completed the formation of the cut enters the hollow space of the pressing member that have taken a hanging attitude. As a result, the rotary blade and the pressing member more or less overlap when seen from the side, and the action point of the pressing member that presses and splits the tile by the operation of the lever is near the hinge connecting portion of the base portion of the operating lever that acts as a supporting point. Accordingly, the force of the operator that is applied to the grip of the operating lever that acts as a force point is amplified, and the pressing plates of the pressing member press and split the tile.

Consequently, compared to the prior art structure in which the rotary blade and the pressing member are separated to the front and rear with respect to the base portion of the operating lever, reliable pressing and splitting of tiles is accomplished efficiently and with a small force regardless of the material, thickness, size, etc. of the tile to be split. Furthermore, the tile cutter of the present invention can be made compact in terms of configuration, and the pivot operation range of the operating lever can be large. Thus, the tile cutter of the present invention is easy to use with good operating characteristics.

In the tile cutter of the present invention, a tile is placed on the base stand with the intended cutting line of the tile aligned with the protruding rib, and a cut is formed in the tile by maneuvering the operating lever so that the rotary blade at the base portion of the operating lever is moved while being pressed against the surface of the tile. Then, when the cut is made on the tile, the tile is pressed and split along the cut merely by pivoting down the operating lever so that the undersurfaces of the pressing plates that are supported on the base portion of the operating lever are pressed against the surface of the tile. Thus, the series of operations from the formation of a cut in the surface of the tile to the splitting of the tile are efficiently and reliably performed by the action of the lever. The tile cutter has high operating characteristics.

Furthermore, in the tile cutter of the present invention, the base portion of the operating lever and the rotary blade are fitted into the central hollow space of the pressing member. Accordingly, the pivot operation range of the operating lever is large, the operating characteristics of the cutter is high, and the tile cutter is easy to handle and easy to use.

DETAILED DESCRIPTION OF THE INVENTION

The tile cutter of the present invention will be described in concrete terms below with reference to the accompanying drawings.

Figure 1:
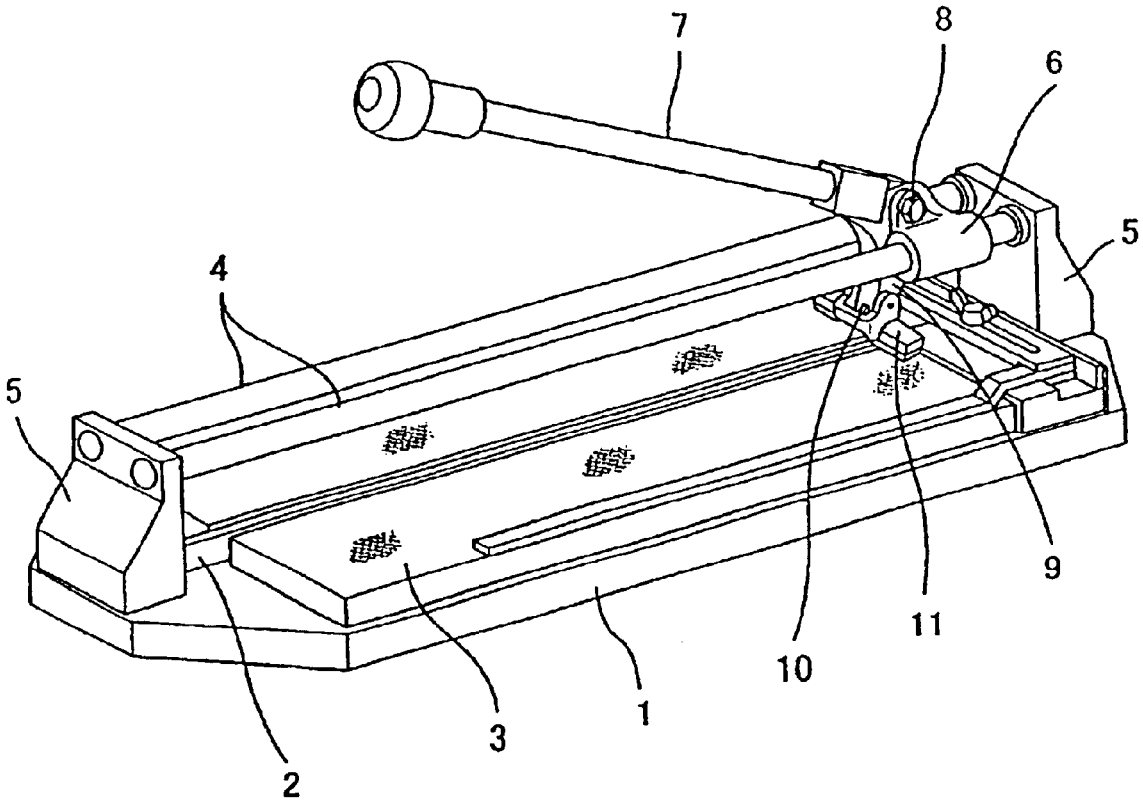
FIG. 1 is an overall perspective view of the tile cutter according to the present invention.
Figure 2:
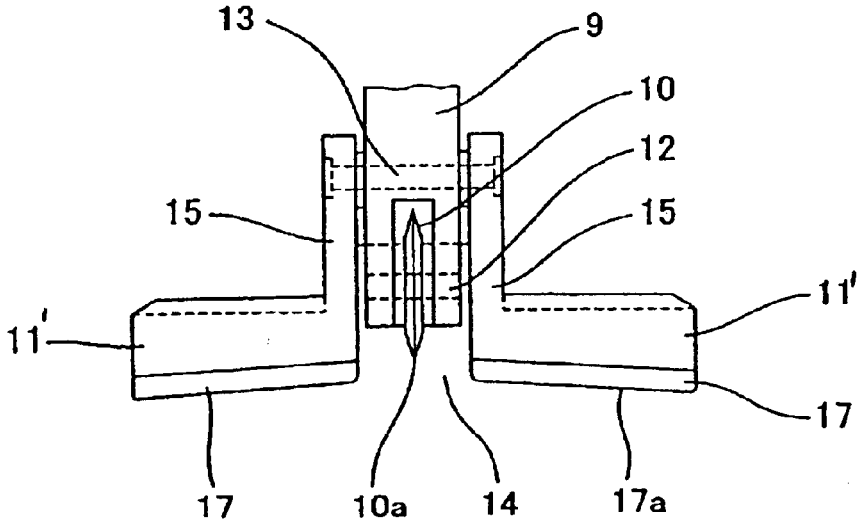
FIG. 2 is a front view of the base portion of the operating lever where the rotary blade and pressing plates are attached.
Figure 3:
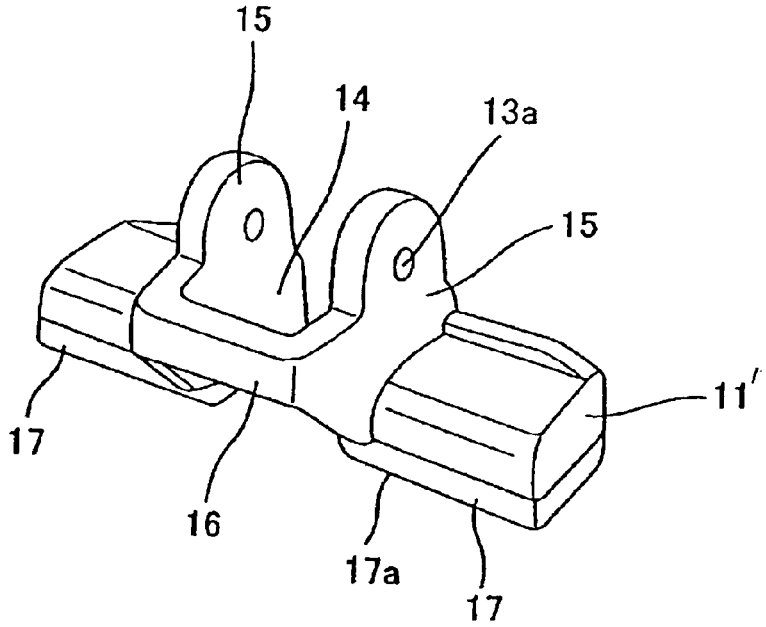
FIG. 3 is a perspective view of the pressing member viewed from the rear side.

In FIGS. 1 through 3, the reference numeral 1 indicates a base stand of the tile cutter. The base stand 1 has a substantially rectangular shape when viewed from above, and it has a protruding rib 2 provided in the direction of length of the base stand 1 in the center. Elastic sheets 3 are pasted to the surface of this base stand 1 so that they are on both sides of the protruding rib 2 and are slightly lower in height than the protruding rib 2, thus forming a tile carrying surface.

Two parallel guide rails 4 are supported by a front supporting stand 5 and by a rear supporting stand 5' that are installed upright on the front (left side in FIG. 1) end and rear (right side in FIG. 1) end of the base stand 1. The guide rails 4 are disposed above the protruding rib 2 in a bridge-like configuration.

The reference numeral 6 is a moving base which is installed so as to move or slide on the guide rails 4. An operating lever 7 is hingedly connected at point 8 to the moving base 6. The base portion 9 of the operating lever 7 extends below the guide rails 4 at a specified angle with reference to the operating lever 7. A rotary blade 10, which makes a cut in the surface of a tile placed on the base stand 1, and a pressing member 11, which includes pressing plates 11' that press and split the tile placed on the base stand 1, are provided on the lower end of the base portion 9 respectively by a blade supporting shaft 12 (for the blade 10) and a pressing member supporting shaft 13 (for the pressing member 11).

The rotary blade 10 is made of a super-hard alloy such as tungsten carbide. As shown in FIG. 2, a double-edged blade 10*a* which is in a V shape in cross section is formed around the circumferential edge of the rotary blade 10, and this rotary blade 10 is rotatably provided on the blade-supporting shaft 12.

As seen from FIGS. 2 and 3, the pressing plates 11' of the pressing member 11 are separated to the left and right with a hollow space 14 in between or in the central portion. Supporting portions 15 which respectively have shaft holes 13*a* are formed on the (inner) ends of the left and right pressing plates 11' that face each other, and the rear portions (front sides in FIG. 3) of these supporting portions 15 are connected by a C-shaped connecting element 16 so that the pressing plates 11' make an integral single unit. The hollow space 14 is expanded into the interior of this C-shaped connecting element 16. Pressing pads 17 made of rubber are attached to the undersurfaces of the pressing plates 11' so that only the pressing pads 17 of the pressing member 11 come into contact with the tile to be handled.

The pressing member 11 that includes the pressing plates 11' is mounted on the base portion 9 of the operating lever 7. More specifically, the pressing member supporting shaft 13 is passed through the shaft holes 13*a* of the supporting portions 15 so that the pressing member supporting shaft 13 is, as best seen from FIG. 4, located above the blade supporting shaft 12 of the rotary blade 10 and is shifted slightly to the rear side from the blade supporting shaft 12. As a result, the pressing member 11 is freely swingable upward and downward about the pressing member supporting shaft 13.

Under ordinary conditions, when the pressing member 11 takes a hanging attitude by the pressing member supporting shaft 13, the lower end portion of the base portion 9 of the operating lever 7 and the rotary blade 10 are in the interior of the hollow space 14 of the supporting member 12, and the undersurfaces 17*a* of the pressing pads 17 of the pressing plates 11' are at a height level that is lower than the edge 10*a* of the rotary blade 10 (or are closer to the top surface of the base stand 1).

The tile cutter of the present invention as described above is used in the manner shown in FIGS. 4 through 6.

With the operating lever 7 being raised, a tile T is placed on the base stand of the tile cutter with an intended cutting line of this tile T aligned with the protruding rib 2. Then, the operating lever is lowered so that the rotary blade 10 is brought into contact with the top surface of the tile T at one end (front end) of the tile. Then, by the operation of the operating lever 7 along the guide rails 4, the rotary blade 10 is moved while being pressed against the tile T from one end (left side in FIG. 1) to the other (right side in FIG. 1) of the tile. As a result, a groove-form cut with a specified depth is cut into the surface of the tile.

Figure 4:
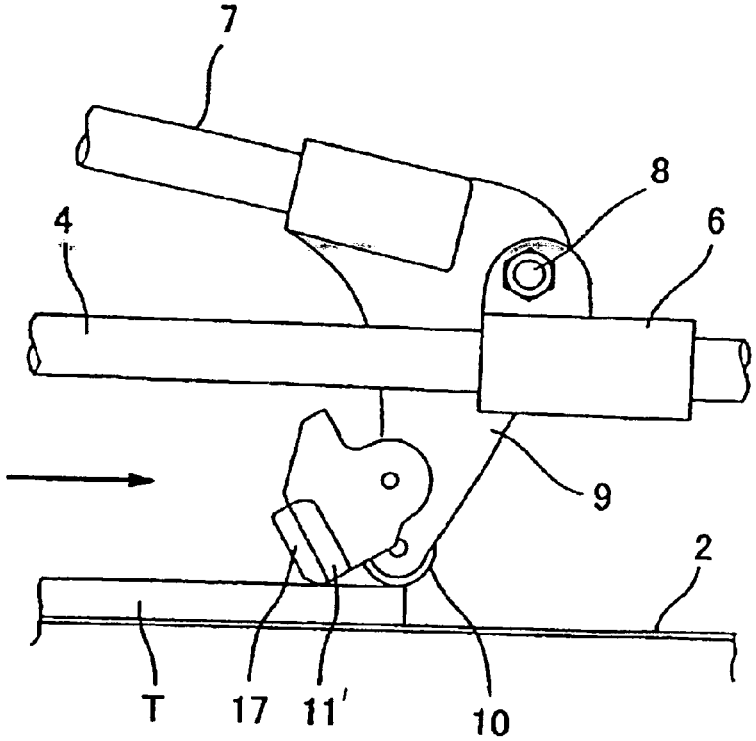
FIG. 4 is a side view illustrating the cut being made in the surface of a tile.

The pressing member 11 takes a hanging attitude with respect to the base portion 9 of the operating lever 7 when the operating lever 7 is lifted (or raised) and until the rotary blade 10 begins to be moved from one end of the tile T. Immediately after the operating lever 7 is lowered (or pivoted down) and the rotary blade 10 begins to be moved while being pressed against the surface of the tile, the pressing plates 11' of the pressing member 11 are, as shown in FIG. 4, caused to ride on and slid over the tile surface while being dragged over the tile surface by the base portion 9 of the operating lever. Since only the rubber pressing pads 17 of the pressing plates 11' contact the tile surface, no trouble occurs with making the cut in the tile.

Figure 5:
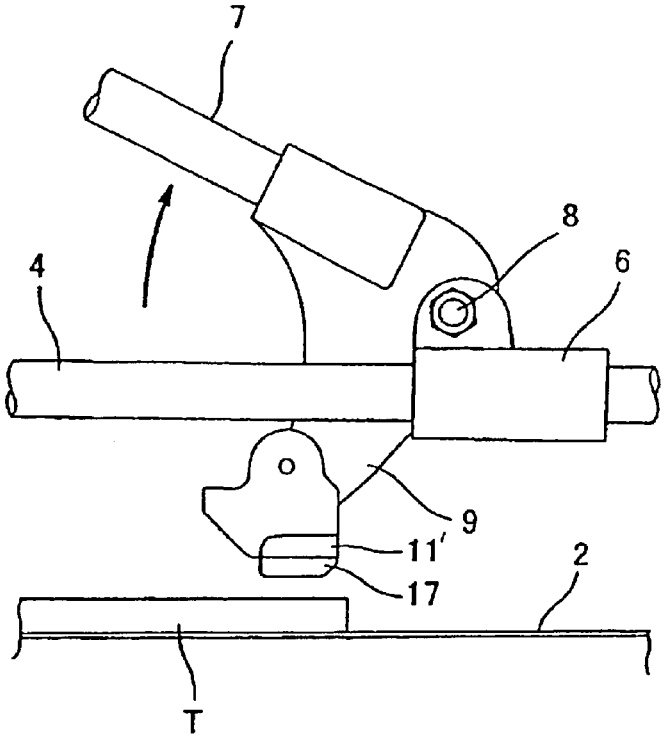
FIG. 5 is a side view illustrating that the operating lever is pivot upward so that the pressing member is brought into the hanging attitude.
Figure 6:
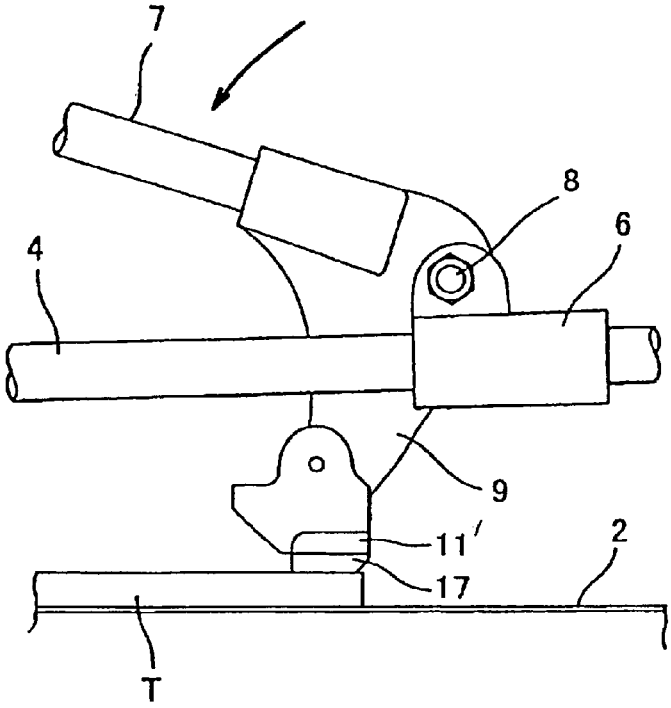
FIG. 6 is a side view illustrating that the operating lever is pivot down so that tile is split along the cut made in the surface of the tile.

When the rotary blade 10 is moved while being pressed against the tile surface as shown in FIG. 4 and reaches the other end of the tile T so that the formation of the cut is completed, the operating lever 7 is pivoted upward, and the rotary blade 10 is lifted from the surface of the tile T as shown in FIG. 5. When the lever 7 is thus raised, the pressing member 11 is lifted from the tile surface and takes a hanging attitude with its own weight, the tip (lower) end of the base portion 9 of the operating lever 7 and the rotary blade 10 that has completed the formation of the cut center the interior of the hollow space 14 between the pressing plates 11' of the pressing member 11, and the pressing member 11 gets closer to the hinge connection-part 8 of the operating lever 7. Accordingly, by way of pivoting down the operating lever 7 in this state as shown in FIG. 6, the undersurfaces of the pressing plates 11' of the pressing member 11 that have taken a hanging attitude (or the undersurfaces 17*a* of the pressing pads 17) are pressed against the surface of the tile. When the operating lever 7 is further pivoted down and thus lowered, the pressing force of the pressing member 11 is increased by the action of the lever, and the tile T is pressed and split into two pieces along the cut on the right and left sides of the protruding rib 2.

In the tile cutter of the present invention, ceramic tiles that are to be mounted on the walls, floors, etc. are securely cut to desired sizes at construction sites. Accordingly, it improves the operating efficiency. Furthermore, the tile cutter of the present invention allows anyone to cut tiles as desired by means of a simple operation without particular experience. The tile cutter of the present invention is thus useful, it can be easily carried to work sites, and tile mounting work can be carried out with high efficiency.

What is claimed is:

1. A tile cutter comprising:

a base stand, a protruding rib disposed on said base stand, guide rails installed so as to be in a bridge configuration above said protruding rib, an operating lever provided on said guide rails so as to be movable while being guided by said guide rails, and a rotary blade and a pressing member installed on a base portion of said operating lever, said rotary blade for forming a cut in a surface of a tile that is placed on said base stand, and said pressing member for pressing said tile surface on both sides of said cut so as to press and split said tile when the operating lever is pushed downward, wherein said pressing member is comprised of a pair of pressing plates which are connected to each other by a C-shaped connecting element with a hollow space between said pair of pressing plates, said pressing member is swingably provided on said base portion of said operating lever adjacent a blade supporting shall of said rotary blade, and a part of said base portion of said operating lever and said rotary blade enter into said hollow space when said operating lever is raised such that said pressing member takes a hanging attitude.

2. The tile cutter according to claim 1, wherein a pressing member supporting shall that supports said pressing member on said base portion of said operating lever is provided above and slightly rearward said blade supporting shaft that supports said rotary blade.

* * * * *